US007846073B2

(12) United States Patent
Summers

(10) Patent No.: US 7,846,073 B2
(45) Date of Patent: Dec. 7, 2010

(54) LEG EXERCISER DEVICE

(75) Inventor: Neil Summers, Dorking (GB)

(73) Assignee: ENANEF Limited, Dorking (GB)

( * ) Notice: Subject to any disclaimer, the term of this patent is extended or adjusted under 35 U.S.C. 154(b) by 0 days.

(21) Appl. No.: 12/555,528

(22) Filed: Sep. 8, 2009

(65) Prior Publication Data

US 2010/0062912 A1 Mar. 11, 2010

(30) Foreign Application Priority Data

Sep. 9, 2008 (GB) ..... 0816453.5

(51) Int. Cl.
*A63B 22/20* (2006.01)
*A63B 23/04* (2006.01)
*A63B 21/08* (2006.01)

(52) U.S. Cl. ..... 482/70; 482/79; 482/97; 482/135; 482/145

(58) Field of Classification Search ..... 482/51, 482/70, 71, 79, 92–94, 101, 132, 135, 141, 482/145, 148, 907, 97
See application file for complete search history.

(56) References Cited

U.S. PATENT DOCUMENTS 4,149,713 A * 4/1979 McLeod ..... 482/101
4,781,372 A * 11/1988 McCormack ..... 482/70
4,811,941 A * 3/1989 Elo ..... 482/51
5,064,190 A * 11/1991 Holt ..... 482/70
5,295,935 A * 3/1994 Wang ..... 482/130
6,019,709 A * 2/2000 Piaget ..... 482/70
D512,111 S * 11/2005 Summers ..... D21/668
D550,312 S * 9/2007 Summers ..... D21/668
D589,573 S * 3/2009 McVay et al. ..... D21/668
D620,540 S * 7/2010 McVay et al. ..... D21/668
2004/0033866 A1* 2/2004 Shapiro ..... 482/93
2004/0241631 A1 12/2004 Nizamuddin

FOREIGN PATENT DOCUMENTS

DE 4229970 A1 * 3/1994
DE 202008000951 U1 4/2008
DE 202008004769 U1 6/2008
DE 202008005296 U1 7/2008
GB 2274999 A * 8/1994
JP 2005177405 A * 7/2005
WO WO 9007362 A1 * 7/1990

* cited by examiner

*Primary Examiner*—Loan Thanh
*Assistant Examiner*—Victor K Hwang
(74) *Attorney, Agent, or Firm*—Townsend and Townsend and Crew LLP

(57) ABSTRACT

The present invention provides for a leg exerciser device offering a pair of footplates arranged for inward and outward reciprocal movement along a respective pair of rails and whereby each of the footplates is operatively connected by way of support arms to a variable number of weights so as to increase the resistance offered by apparatus during an exercise routine. The path of travel of each footplate and the configuration of each arm is such that the vertical distance moved by the weights is greater than the vertical distance moved by each footplate during its reciprocal motion along the rails so as to enhance the degree of work undertaking during an exercise routine.

11 Claims, 5 Drawing Sheets

LEG EXERCISER DEVICE

BACKGROUND OF THE INVENTION

1. Field of the Invention

The present invention relates to a leg exerciser device and in particular such a device for exercising the inner and outer thigh muscles of a user.

2. Background

A wide variety of exercise devices are commonly known for improving the strength and tone of various portions of the human body including in particular the human legs.

One such known device has a particular configuration forming the subject matter of UK Design Registration 3011754 and which presents a pair of footplates arranged for reciprocal movement along commonly aligned downwardly concave rails such that as the user, when in prone position standing on the footplates, moves the footplates reciprocally in the lateral direction the curvature offered by the downwardly convex rails causes the user's body to be raised and lowered in a vertical direction. The lateral movement of the footplates then serves to work against the user's own weight and thereby work, in particular, the thigh muscles of the user's legs.

The nature and degree of exercise undertaken by the user is then dependent solely upon the weight of the user.

BRIEF SUMMARY OF THE INVENTION

The present invention seeks to provide for a leg exerciser device having further advantageous Features over and above such known devices.

According to the present invention there is provided a leg exerciser device comprising a pair of footplates arranged for reciprocal movement on respective support means, the support means extending outwardly on a common line from either side of a central portion of the device to respective lateral portions thereof, the footplates being arranged to receive a pair of human feet disposed substantially perpendicular to the said common line of extension of the support means and so as to be moved by a user in a reciprocal manner between the said central portion and the said lateral portions as part of an exercise routine, each footplate further being arranged to operatively engage at least one exercise weight in manner so as to raise the said weight through a vertical distance during at least one stroke of the said reciprocal movement.

The invention is particularly advantageous in that, in addition of the said at least one exercise weight, the degree of work undertaken during an exercise routine can be readily adjusted independently of the user's weight and independently of any requirement for the footplates to move otherwise in their reciprocating inward/outward movement relative to the central portion of the device.

The device can be arranged to receive a selective plurality of weights to allow for the selective variation of the resistance to movement offered during an exercise routine. In particular, each of the selective plurality of weights is arranged to be fluid-filled, or sand/particulate-filled.

In one particular aspect, a rigid connector is provided for the operative connection between the footplate and the exercise weight such that, during outward movement of the footplate, the rigid connector and associated weight, extends beyond the said lateral portions of the device.

Preferably, the said weights are arranged to be located at the end of an arm which is connected to the footplate.

Advantageously, the said arm is arranged to be supported during its movement by a surface a lateral portion of the device.

Advantageously, the said surface is arranged to comprise a cam surface.

Alternatively, or in addition, the said cam surface can comprise a bearing surface.

In particular, the said surface can be provided by that of a roller wheel rotably mounted within the said lateral portion.

The roller wheel advantageously includes a circumferential channel portion for receipt of the said arm.

Advantageously, the height of the said support surface of the lateral portion relative to the footplate can be varied.

As will be appreciated, through increasing the height of the said support surface relative to the footplate, the end of the arm supporting the said weight can be caused to move through a greater vertical distance thereby further enhancing the resistance offered during an exercise routine.

Preferably, the said arm can have a generally downwardly concave configuration.

In particular, the said support means can be arranged to offer a shallow concave path which can be arranged to match the downwardly concave configuration of the support arm.

As will be appreciated, the present invention provides an advantageous adaptation of known leg exerciser apparatus and through which an easily, and accurately, variable adjustment to the resistance offered during an exercise routine can be provided quite independently of the size and weight of the user. The height through which the weight can be moved can also advantageously be enhanced.

BRIEF DESCRIPTION OF THE DRAWINGS

The invention is described further hereinafter, by way of example only, with reference to the accompanying drawings in which.

DETAILED DESCRIPTION OF THE INVENTION

Figure 1:
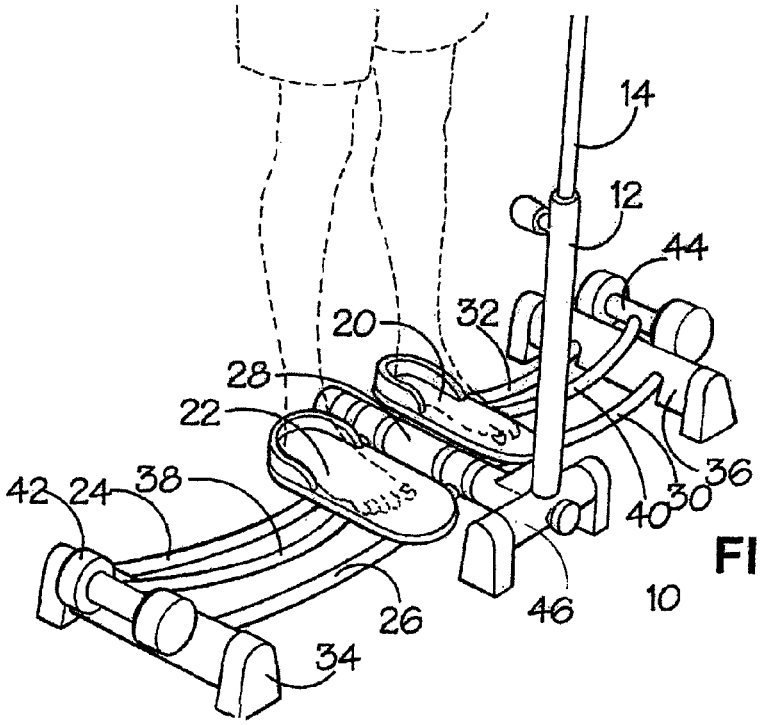
FIG. 1 is a perspective view of a leg exerciser device according to one embodiment of the present invention.

Turning first to FIG. 1 the perspective view of an embodiment of the present invention shows a leg exerciser device 10 having an upstanding telescopic central support 12, 14 from the upper end of which extend in a transverse manner a pair of handles 16, 18 to be gripped by a user during an exercise routine.

The device 10 further comprises a pair of footplates 20, 22 each arranged to receive a foot of the user and which are movably mounted upon laterally extending support means so as to allow for reciprocal movement of each footplate 20, 22.

The support means for footplate 22 comprise parallel downwardly curved rails 24, 26, and which are connected to a central region 28 of the device 10 and from one end of which extends the central support 12, 14.

Likewise, connected to the central region 28 are a pair of similarly downwardly curved rails 30, 32 upon which the other 20 of the two footplates is movably mounted.

The movable mounting of the footplates 20, 22 to the rails 24, 26; 30, 32 can be provided by any appropriate bearing means/surface as required.

As will be appreciated, the rails 24, 26; 30, 32 extend along a common line from the central region 28, and which common line is substantially perpendicular to the longitudinal extent of each footplate 20, 22.

The ends of the rails 24, 26 remote from the central region 28 of the device 10 are connected to a sidewall member 34 of the device 10, whereas the ends of the rails 30, 32 remote from the central region 28 are mounted to the second sidewall member 36.

As will be appreciated from the following, the sidewall members 34, 36 perform an important function in the illustrated embodiment of the present invention, but likewise provide lateral supports for the secure floor-location of the device 10 when in use.

Operatively connected to each of the footplates 22, 20 is a respective pair of outwardly extending curved support arms 38, 40 which, as illustrated, have a configuration similar to that of each of the rails 24, 26; 30, 32.

Each of the curved support arms 38, 40 is operatively connected to its respective footplate 22, 20 and is provided at its remote end with means for receiving one of a pair of exercise weights 42, 44.

Figure 2:
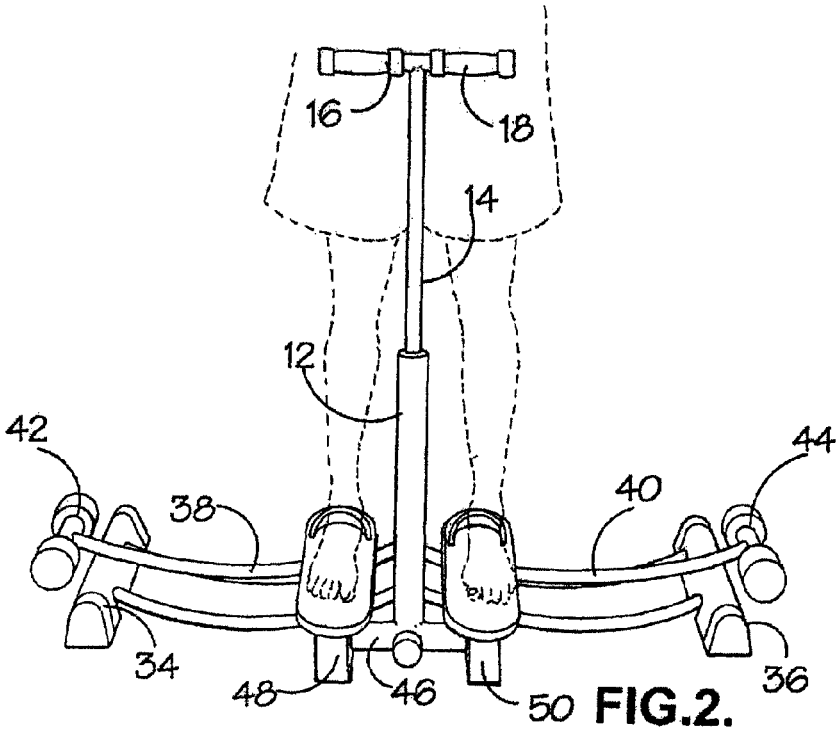
FIG. 2 is a front raised view of the device of FIG. 1.

The full detail and configuration of this particular embodiment of the present invention can be further appreciated from FIG. 2 whereby it can be appreciated that each of the exercise weights 42, 44, is located adjacent each of the respective side wall members 34, 36 when each footplate 20, 22 is at the end of its inward stroke.

Also, the central portion 28 of the device 10 includes a front end comprising a transverse support arm 46 having a pair of feet 48, 50 and respective ends thereof for further enhancing the floor-mounted stability of the device 10.

Figure 3:
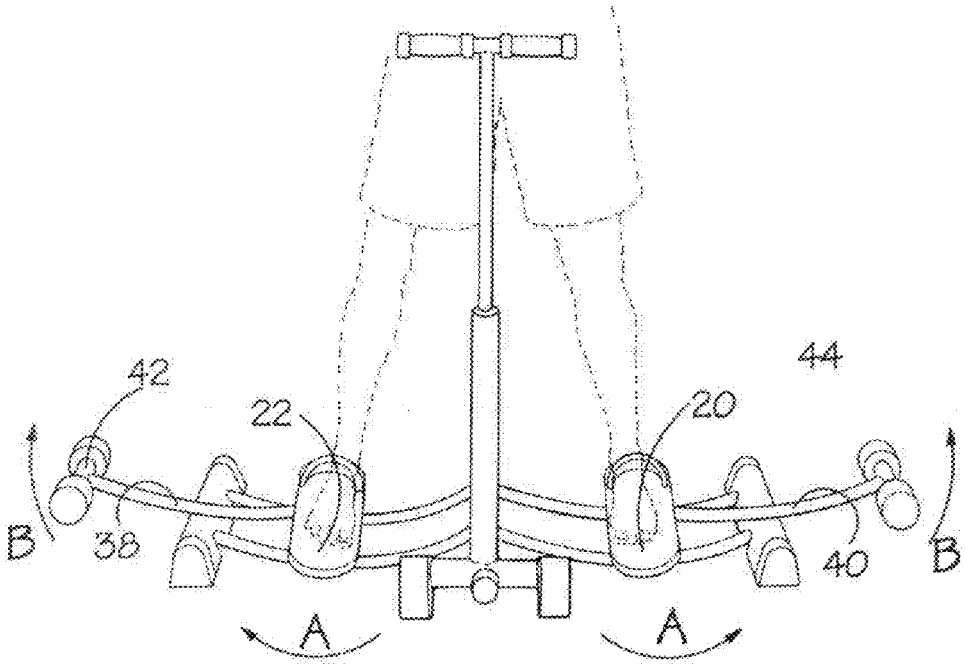
FIG. 3 is a similar view to that of FIG. 2 but showing the footplates thereof moved during an exercise routine.
Figure 4:
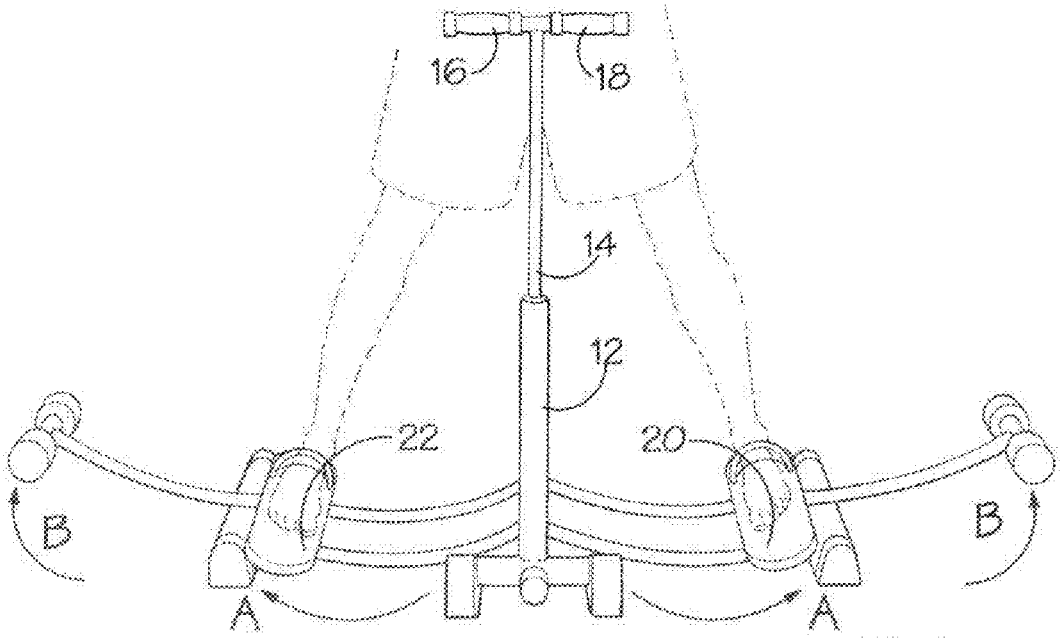
FIG. 4 is a view similar to that of FIG. 3 but illustrating the footplates moved to their maximum extent from the central portion of the device.

Turning now to FIGS. 3 and 4, use of the device 10 is described as follows.

As mentioned previously, the footplates 20, 22 are arranged for reciprocal movement between the central portion 28 and sidewall members 34, 36 of the device 10 during an exercise routine.

Through employment of the downwardly curved tracks 24, 26; 30, 32 the user's body is repeatedly raised and lowered such that the leg muscles causing the reciprocal outward and inward movement of the footplates 20, 22 work against the user's body weight.

In FIG. 3, movement of the footplates 20, 22 in an outward direction is illustrated by arrows A is illustrated. Also, and through the rigid connection offered by the curved arms 38, 40 to the respective weights 42, 44, those weights 42, 44 are likewise moved along a curved path indicated by arrows B.

However, due to the length and configuration of the arms 38, 40 it will be appreciated that, as illustrated by the respective directions of the arrows B, the vertical distance moved by the weights 42, 44 during the outward stroke of the footplates 20, 22 in the direction of the arrows A is in fact far greater than the vertical distance moved by the footplates 20, 22.

This advantageously increases and enhances the amount of work undertaken by the user's legs during an exercise routine.

In the above-mentioned embodiment, each sidewall member 34, 36 is provided with a roller wheel and guide channel, for assisting stable movement of the arms 38, 40 in a reciprocal manner.

According to a particularly advantageous feature of the present invention, illustrated clearly in the drawings, the vertical distance between the surface of the sidewall members and any associated roller wheels, relative to that of the footplates 20, 22 can be varied so as to likewise vary the extent of the vertical distance through which each of the weights 42, 44 moves in a direction Arrows B. That is, through increasing the vertical distance between the aforesaid support surface/roller wheel of the sidewall member 34, 36 and the footplate 20, 22, the angle at which the arm 38, 40 extends from the footplate 20, 22 as the footplate approaches the sidewall member 34, 36 is increased which serves, as noted, to increase the vertical distance of travel of the weights 42, 44.

In this regard, each arm 38, 40 can be pivotally mounted to its respective footplate 22, 20 and the height adjustment at the sidewall member 24, 36 can be readily adjusted as required.

Figure 5:
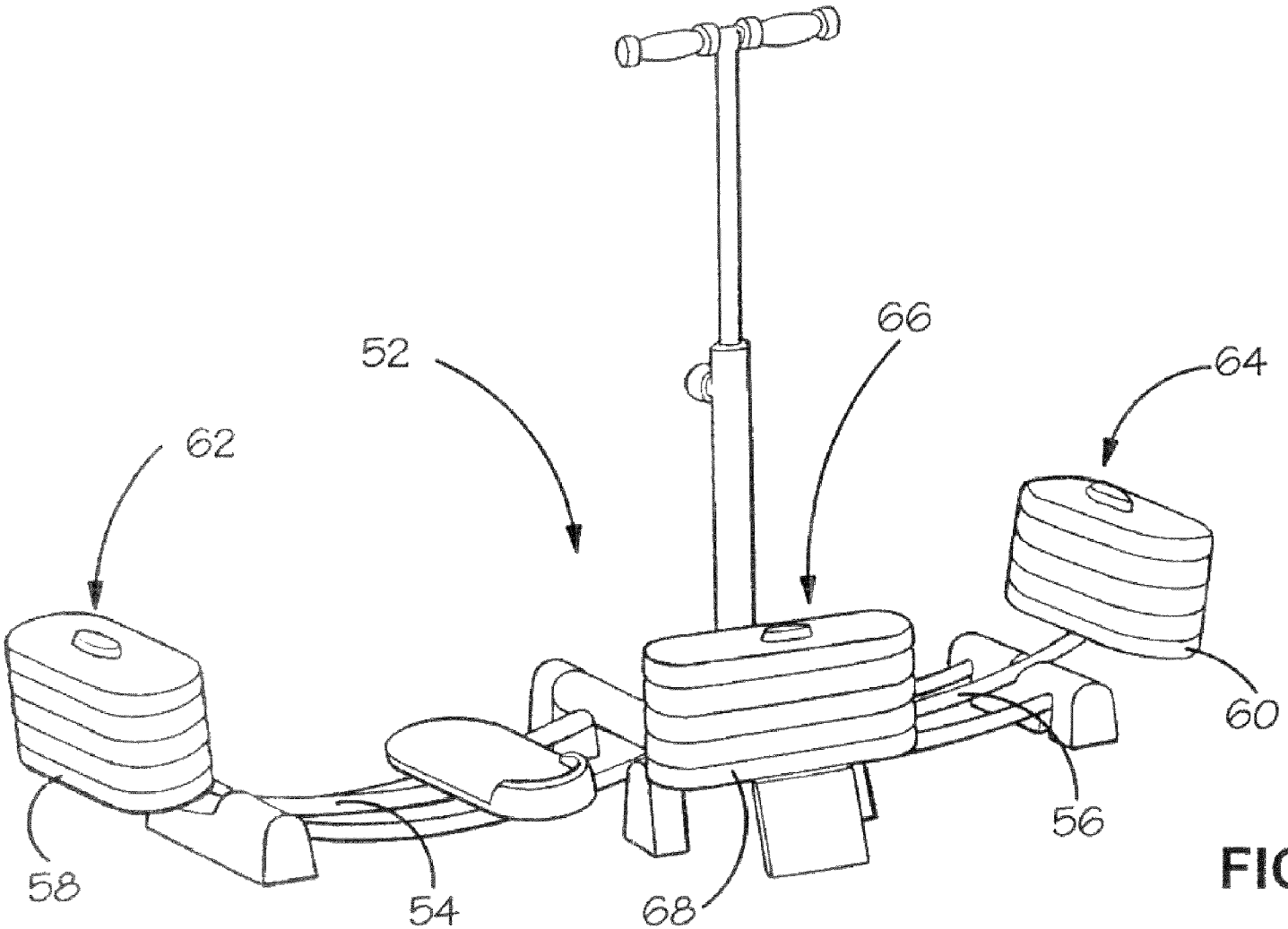
FIG. 5 is a perspective view of apparatus according to another embodiment of the present invention.

Turning now to FIG. 5, there is provided a perspective view of apparatus according to a further embodiment of the present invention.

The exercise apparatus 52 again has a frame-like structure and it will be appreciated that the general configuration is similar to the previously described embodiment and so not all of the features are specifically referenced.

Each of a pair of downwardly arcuate support arms 54, 56 extend to respective weight-supporting plates 58, 60 upon which a respective plurality of shallow weight blocks 62, 64 are piled.

An engagement formation can be provided so as to allow for the secure mounting of the weight blocks 62, 64 to their respective support plates 58, 60 and, indeed, to their neighbouring blocks. The outer dimensions of the support plates 58, 60 and indeed their weight blocks 62, 64 are generally similar, if not identical, to that of the footplates.

The central region of the apparatus 52 also provides a stationary weight support plate 68 upon which weights 66 which are not currently required for use within an exercise routine can be stored.

As will be appreciated, the weight blocks 62, 64, 66 can each be of a predetermined weight so that, when combined, a desired absolute weight can be provided. Further, each such weight block 62, 64, 66 can be solid or indeed hollow so as to receive a fluid and/or particulate matter such as sand therein so as to provide for the weight required.

Figure 6:
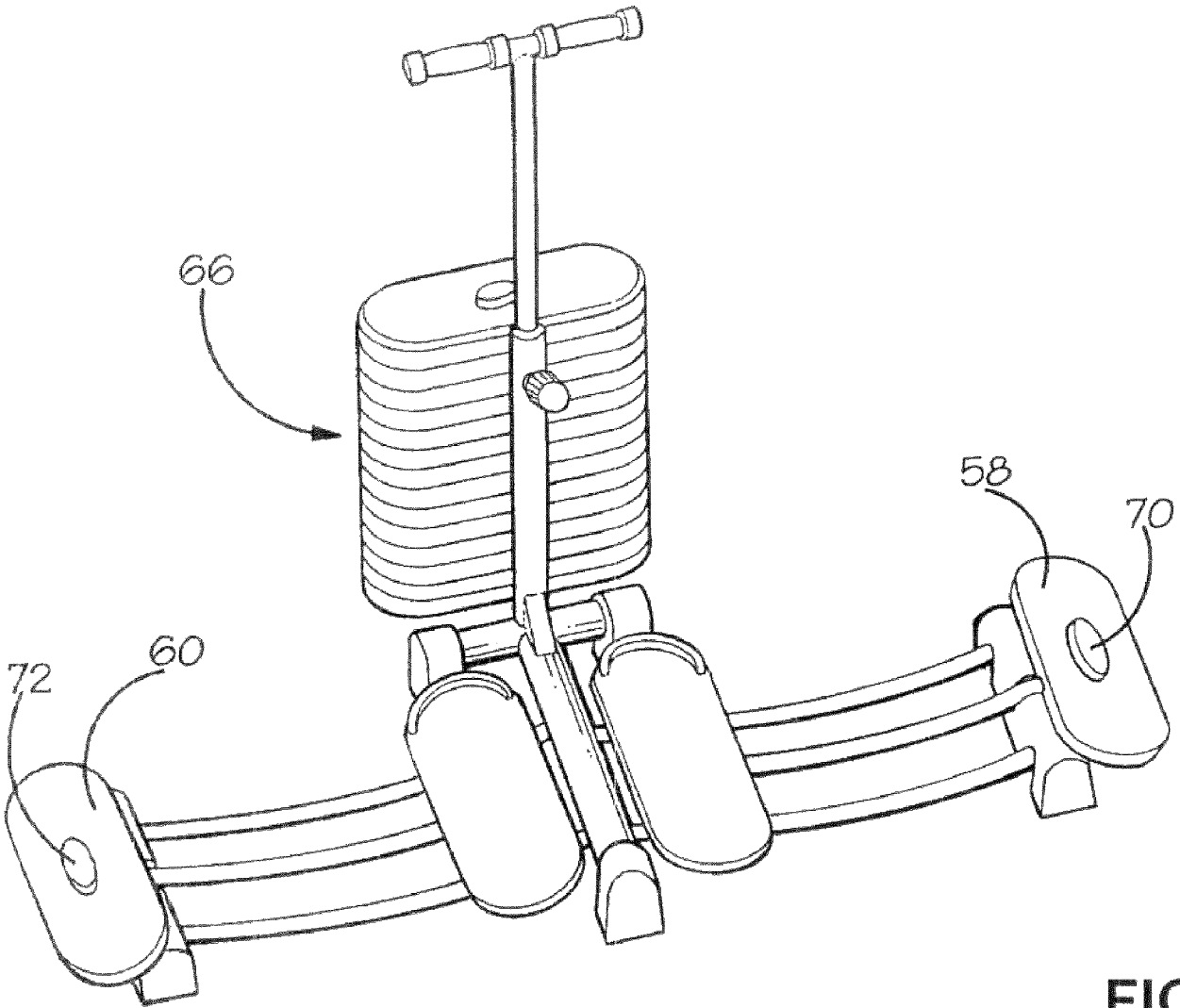
FIG. 6 is an elevated plan view of the apparatus of FIG. 5 but with the weights shown in a storage pile.

Turning now to FIG. 6 there is provided a perspective view from an opposite side to that of FIG. 5 and with all of the weights provided in a central storage pile 66 on the stationary support plate 68 (see FIG. 5).

The similar dimensions between the weight support plates 58 and 60 and the footplates can be readily appreciated as can a respective indent 70, 72 provided on each of the weight support plates 58, 60 so as to securely engage with a weight block by way of weight blocks 66 which has an overall recess of similar dimensions for keyed engagement with the support plate 58, 60.

A further advantageous feature of this further embodiment of the present invention is that it can be readily folded for ease of efficient storage.

Figure 7:
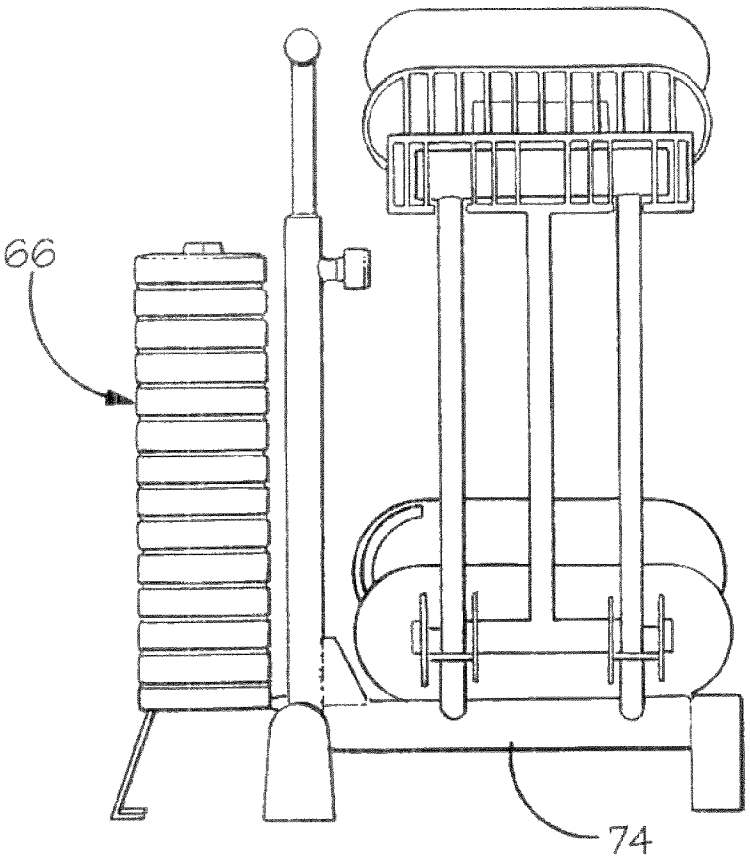
FIG. 7 is a side view of the embodiment as illustrated in FIG. 6 but with the footplates supporting tracks folded upwardly.

That is, with regard to FIG. 7, there is provided a side view of the apparatus of FIG. 6 with all of the weight blocks provided in a single stored pile 66 and which further illustrates the connection of the footplate support rails by way of a pivotally mounted support rod 74 allowing for pivotal motion of each of the lateral foot supporting regions of the apparatus between the generally horizontal, generally vertical, positions.

Figure 8:
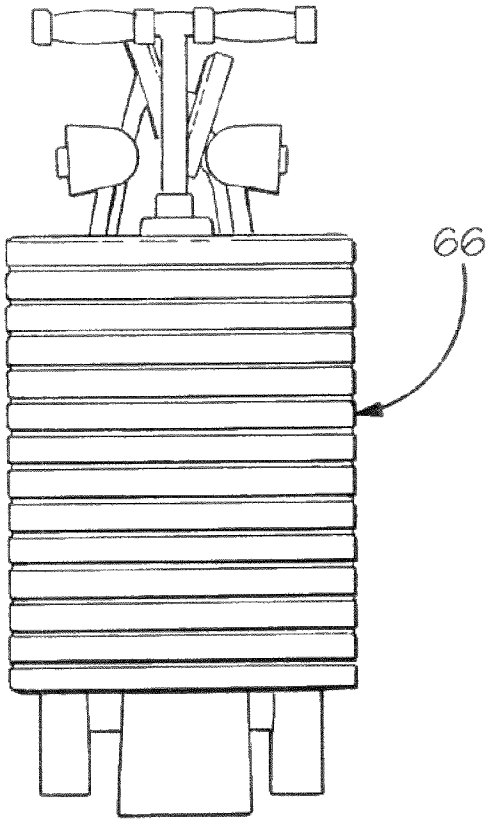
FIG. 8 is a front-view of the embodiment as illustrated in FIG. 7.

In FIG. 7, and indeed as with reference to FIG. 8, the support portions which comprise the support rails having been folded upwardly into generally vertical position for ease of storage as will be appreciated from reference to FIGS. 7 and 8.

It should of course be appreciated that the invention is not restricted to the details of foregoing embodiments.

In particular, the various features illustrated in the further embodiment of FIGS. 5-8 can, if required, be readily incorporated into the earlier embodiment and vice versa.

Although not illustrated in the drawings, the ends of the arms 38, 40 can be arranged to receive an increasing number of exercise weights in a selective manner and so as to readily vary the weight located at the end of each arm 38, 40 and against which the user works during an exercise routine. The weights can be solid or arranged to be fluid filled as required.

The weights can be operatively connected to the footplates by any appropriate mechanism and the support arrangements for the device for engagement by the user, and for allowing the support of the footplates, can be provided by any appropriate configuration as required.

What is claimed is:

1. Leg exerciser device comprising a pair of footplates arranged for reciprocal movement on respective support means, the support means extending outwardly on common line from either side of a central portion of the device to respective lateral portions thereof, the footplates being arranged to receive a pair of human feet disposed substantially perpendicular to the said common line of extension of the support means and so as to be moved by a user in a reciprocal manner between the said central portion and the said lateral portions as part of an exercise routine, each footplate further being arranged to operatively engage at least one exercise weight in manner so as to raise the said weight through a vertical distance during at least one stroke of the said reciprocal movement;

wherein a rigid connector is provided for the operative connection between the footplate and the exercise weight such that, during outward movement of the footplate, the rigid connector and associated weight, extends beyond the said lateral portion of the device.

2. A device as claimed in claim 1 and arranged to receive a selective plurality of weights to allow for the selective variation of the resistance to movement offered during an exercise routine.

3. A device as claimed in claim 1, wherein the weights are arranged to be fluid-filled.

4. A device as claimed in claim 1, wherein the said weights are arranged to be located at the end of an arm connected to the footplate.

5. A device as claimed in claim 1, wherein the rigid connector is arranged to be supported during its movement by a support surface of the said lateral portion of the device.

6. A device as claimed in claim 5, wherein the said support surface is arranged to comprise a cam surface.

7. A device as claimed in claim 5, wherein the said support surface comprises a bearing surface.

8. A device as claimed in claim 5, wherein the said support surface is provided by a roller wheel rotably mounted within the said lateral portion.

9. A device as claimed in claim 5, and arranged such that the height of the said support surface of the lateral portion relative to the footplate can be varied.

10. A device as claimed in claim 1, wherein the rigid connector has a generally downwardly concave configuration.

11. A device as claimed in claim 10, wherein the said support means is arranged to offer a shallow concave path which can be arranged to match the downwardly concave configuration of the support arm.

* * * * *